US007127751B2

(12) United States Patent
Lebrun et al.

(10) Patent No.: US 7,127,751 B2
(45) Date of Patent: Oct. 31, 2006

(54) METHOD FOR MOUNTING A RECESSED MICRO JET IN A WHIRLPOOL BATH AND A KIT THEREFOR

(75) Inventors: Nicolas Lebrun, St-Isidore (CA); Steve Donnelly, Saint-Antoine de Tilly (CA); Bernard Lebrun, St-Joseph de Levy (CA)

(73) Assignee: Maax Canada Inc., Montréal (CA)

( * ) Notice: Subject to any disclaimer, the term of this patent is extended or adjusted under 35 U.S.C. 154(b) by 0 days.

(21) Appl. No.: 10/700,595

(22) Filed: Nov. 5, 2003

(65) Prior Publication Data

US 2004/0199992 A1 Oct. 14, 2004

(30) Foreign Application Priority Data

Nov. 4, 2003 (CA) ..... 2448139

(51) Int. Cl.
*A61H 33/02* (2006.01)

(52) U.S. Cl. ..... 4/541.6; 4/584; 239/282; 285/139.2; 285/141.1; 285/206

(58) Field of Classification Search ..... 4/492, 4/507, 541.1, 541.3, 541.5, 541.6, 58, 4; 285/139.1, 139.2, 141.1, 192, 193, 194, 206, 285/902; 239/282
See application file for complete search history.

(56) References Cited

U.S. PATENT DOCUMENTS

| | | | | |
|---|---|---|---|---|
| 3,297,025 | A | 1/1967 | Jacuzzi | 4/541.6 X |
| D226,405 | S | 2/1973 | Jacuzzi et al. | D24/204 |
| 4,249,522 | A | 2/1981 | Carrier | 4/541.5 X |
| 4,261,347 | A | 4/1981 | Spencer, III et al. | 4/541.6 |
| 4,264,039 | A * | 4/1981 | Moreland | 4/541.6 X |
| 4,383,340 | A | 5/1983 | Braun, Jr. | 4/541.1 |
| 4,408,721 | A | 10/1983 | Cohen et al. | 4/541.6 X |
| 4,800,046 | A | 1/1989 | Malek et al. | 4/541.6 X |
| 4,825,854 | A | 5/1989 | Henkin et al. | 4/541.6 |
| 4,901,926 | A | 2/1990 | Klotzbach | 4/541.6 X |
| 5,000,665 | A | 3/1991 | Moeller | 4/541.6 X |
| 5,265,286 | A | 11/1993 | Filipponi | 4/541.6 |
| 5,279,003 | A | 1/1994 | Gape et al. | 4/541.6 |
| 5,353,447 | A | 10/1994 | Gravatt | 4/541.6 |
| 5,495,627 | A | 3/1996 | Leaverton et al. | 4/541.6 |
| 5,526,540 | A | 6/1996 | Johnson | 4/541.6 |
| 5,754,989 | A | 5/1998 | Ludlow | 4/541.6 |
| 5,983,416 | A | 11/1999 | Idland | 4/541.1 |
| 6,052,844 | A | 4/2000 | Walsh et al. | 4/541.1 |
| 6,186,964 | B1 | 2/2001 | Branham | 4/541.6 X |
| D449,382 | S | 10/2001 | Collins et al. | D24/204 |
| 6,317,903 | B1 | 11/2001 | Brunelle et al. | 4/541.4 |
| 2002/0112284 | A1 | 8/2002 | Collins et al. | 4/541.1 |

* cited by examiner

*Primary Examiner*—Robert M. Fetsuga
(74) *Attorney, Agent, or Firm*—Ogilvy Renault, LLP

(57) ABSTRACT

This invention relates to a method for mounting micro jets on whirlpool bath surfaces. Micro jets are mounted in the bottom of cups. The cup containing the micro jet is mounted in an opening performed in the whirlpool bath shell. The proposed method is specially interesting for jets located on surfaces where fluid flows are obstructed such as the surface where a person's back rests when someone lies in a whirlpool bath. This method allows manufacturers to install micro jets those whirlpool bath surfaces without having a recessed part. Moreover, it allows to modify easily the fluid jet pattern depending on the consumer's needs. The present invention also concerns recessed micro jets for whirlpool baths and method for mounting the same.

4 Claims, 3 Drawing Sheets

METHOD FOR MOUNTING A RECESSED MICRO JET IN A WHIRLPOOL BATH AND A KIT THEREFOR

This application claims priority of Canadian patent application no. 2,448,139, now pending, filed on Nov. 4, 2003 by Applicant, the specification of which is hereby incorporated by reference.

BACKGROUND OF THE INVENTION a) Field of the Invention

The present invention relates to a method for mounting a recessed micro jet on a whirlpool bath surface, particularly on a slanted wall thereof, and a kit therefore. More particularly, the invention allows to mount a micro jet in a recess position in an opening performed in the whirlpool bath shell. The present invention also concerns a recessed micro jet whirlpool baths and a method for mounting the same.

b) Description of Prior Art

In whirlpool baths, water and/or air jets are disposed in several areas to impart turbulence in the body of water thereby creating acupressure massaging flows. Those whirlpool baths are great for easing away muscular aches and pains in legs, feet or backs.

For aching backs, jets can be positioned on the slanted wall where a person's back lies. Micro jets are usually used instead of normal jets since the power of normal jets is too strong for enjoyable effects. Micro jets are small jets which usually consist of a cylinder having a port extending therethrough and a flange at one extremity of the cylinder. The micro jet cylinder is inserted inside an opening in the whirlpool bath shell in such way that its flange is contiguous to the interior shell. The micro jet cylinder is connected to a pressurized fluid supply.

However, if micro jets are directly positioned on a whirlpool bath surface obstructed by a body part, the relaxing effect is reduced since the fluid flow is obstructed. In U.S. Pat. No. 4,383,340, a whirlpool bath having a recessed part on the surface where a person's back lies is described. Fluid flows from micro jets mounted in the recessed surface are not obstructed by the person lying in the whirlpool bath and allow an efficient massage action.

However, whirlpool bath manufacturers need different bathtub moulds to produce bathtubs with or without recessed parts for clients who may or may not desire whirlpool micro jets behind their back. This implies more important production costs and stock management. Another option is to have only one bathtub mould which produces bathtubs having at least one recessed parts and to fix cover parts over the recessed parts when the client does not desire whirlpool micro jets behind his back. However, with this technique, the bathtub esthetic aspect is reduced since it is impossible to mask completely the joints between both parts. Therefore, the resulting esthetic aspect of the bathtub displeases several clients who do not desire whirlpool micro jets behind their back.

There therefore exists a need for a new method to dispose micro jets in whirlpool baths, that allows to use the same bathtub mould, without negative esthetic aspect, and permits the production of bathtubs with or without whirlpool micro jets on an obstructed surface, while making sure that the micro jet disposition should allow efficient fluid flows.

SUMMARY OF THE INVENTION

It is an object of the present invention to overcome the problems mentioned previously.

It is another object of the present invention to provide a method for mounting a micro jet in a whirlpool bath which affords an efficient water and/or air flow even if a body part lies on the surface of the bath where the micro jet is mounted.

It is yet another object of the present invention to provide a method for mounting micro jets in whirlpool baths in which the same mould is used to produce bathtubs with or without whirlpool micro jets on a surface that can be obstructed by a body part, without displeasing esthetic aspects.

It is another object of the present invention to provide a kit including recessed micro jets that allow efficient water and/or air distribution even if a body part lies on the surface where a micro jet is mounted.

The above and other objects of the present invention may be achieved by providing a method for mounting a massaging micro jet in a slanted wall of a whirlpool bath, in a recessed position relative to the slanted surface, which comprises a) providing a massaging micro jet, b) providing a massaging micro jet holding cup, the cup being formed with means for mounting same on the slanted wall and a cavity having a recessed bottom partition, the cup having means to fix the micro jet through the recessed bottom partition with the micro jet oriented in a substantially horizontal direction, c) performing an opening in said slanted wall, d) inserting said cup through said opening and fixing same substantially flush with said opening by means of said mounting means, e) introducing said micro jet into said cup, orienting said micro jet in a substantially horizontal direction, and fixing same in said recessed bottom partition by means of said fixing means, and f) connecting said micro jet to a pressurized fluid supply.

The invention also relates to a kit for mounting a massaging micro jet in a slanted wall of a whirlpool bath, in a recessed position relative to the slanted surface, which comprises a) a massaging micro jet, b) a massaging micro jet holding cup, the cup formed with means for mounting same on the slanted wall and a cavity having a recessed bottom partition, the cup having means to fix the micro jet through the recessed bottom partition and orientable in a substantially horizontal direction, c) means for fixing the holding cup substantially flush with the opening by means of the mounting means, and d) means for connecting the micro jet to a pressurized fluid supply.

The invention also relates to a recessed massaging micro jet for slanted wall of a whirlpool bath. The recessed micro jet comprises a cup portion having a mounting flange provided at free end thereof and formed with a cavity and a recessed bottom partition. It also comprises a cylindrical member dependent from the recessed bottom partition and extending past an outer surface of the recessed bottom partition. The cylindrical member has a port extending therethrough. The port terminates into an aperture on an inner surface of the recessed bottom partition.

The invention also concerns a method for mounting a recessed massaging micro jet. The method comprises the following steps:

a) providing a recessed massaging micro jet according to the previous object of the present invention, b) performing an opening in the slanted wall, c) inserting the recessed micro jet through the opening and fixing same substantially flush with the opening, and d) connecting the micro jet circular port to a pressurized fluid supply.

One aspect of the invention provides a massaging microjet assembly in combination with a whirlpool bath having a shell with an inner surface and an opening therein defined in a slanted wall portion of the shell. The massaging microjet assembly comprises: a holding cup having a free end, a first portion and a second portion in fluid communication with the first portion, and a bottom partition recessed from the free end; and a microjet mounted to the bottom partition. The second portion of the holding cup is angularly disposed relatively to the first portion. The holding cup is insertable into the opening in the shell, the holding cup protruding outwardly from the opening when inserted therein and the free end being fixable to the shell. The microjet is connectable to a pressurized fluid supply and has an outlet aperture therein allowing the pressurized fluid to exit therethrough. The outlet aperture is in a substantially horizontal orientation when the holding cup and the microjet are mounted to the shell.

Another aspect of the invention provides a massaging microjet assembly in combination with a whirlpool bath having a shell with an inner surface and an opening defined in a slanted wall portion of the shell. The massaging microjet assembly comprises: a holding cup having a free end and a bottom partition recessed from the free end, and a microjet mounted to the bottom partition. The holding cup is insertable into the opening in the shell and protrudes outwardly from the opening when inserted therein. The free end is securable to the shell. The holding cup has a first portion and a second portion in fluid communication with the first portion and is angularly disposed relatively to the first portion, the angle between the first portion and the second portion is substantially equal to the angle of the slanted wall portion with a horizontal orientation. The microjet has an outlet aperture therein and a connection member protruding outwardly from the bottom partition of the holding cup. The connection member has a port therethrough in fluid communication with the outlet aperture and is connectable to a pressurized fluid supply allowing the pressurized fluid to exit through the outlet aperture of the microjet. The outlet aperture is in a substantially horizontal orientation when the holding cup and the microjet are mounted to the shell.

DESCRIPTION OF PREFERRED EMBODIMENT

The method according to the invention may be achieved by providing a kit that will enable to mount a massaging micro jet in the slanted wall of a whirlpool bath.

Figure 1:
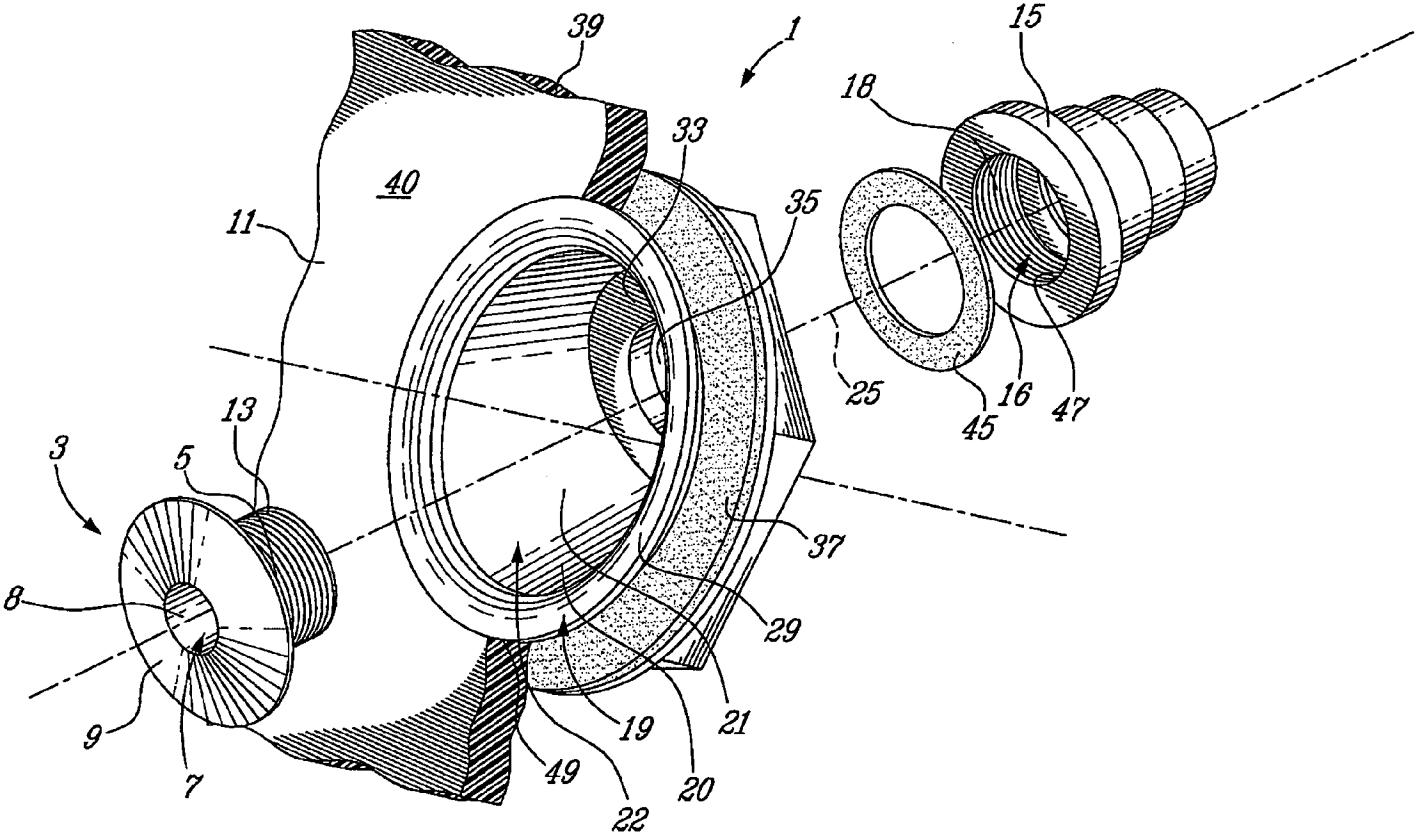
FIG. 1 represents a perspective view of a micro jet and a holding cup being mounted on a slanted wall.

The kit is particularly illustrated in FIG. 1 and will now be described in detail. Kit 1 essentially comprises a massaging micro jet 3 of standard construction. As shown, micro jet 3 consists of a cylindrical member 5 having a circular port 7 extending throughout its length with apertures 8 at opposed ends of the micro jet 3. Cylindrical member 5 is provided at one free end with a fixing flange 9, the purpose of which will be discussed more in detail when describing the method of mounting micro jet 3 in the slanted wall 11 of a whirlpool bath 12 (FIG. 3), which is a section of a bath shell 59. It will also be noted that cylindrical member 5 has a thread 13 (referred to in the claims as the first thread) of standard design that is used for connecting the micro jet to a pressurized fluid supply 80 (FIG. 3 -here water) by means of a connector 15 having a port 16 therein with apertures 18 at opposed ends of the connector 15, which is ideally a jet body. Therefore, in FIG. 1, the micro jet 3 is connectable to the pressurized fluid supply 80, through the connector 15 and, in FIG. 3, the micro jet 3 is connected to the pressurized fluid supply 80. Finally, it will be noted that at the end of port 7 opposite fixing flange 9, there is a polygonal (here hexagonal) grip 17 which enables to prevent micro jet 3 from rotating by inserting a holding tool well known to those skilled in the art, into hexagonal grip 17, when assembling micro jet 7 with connector 15. When assembled, the port 7 of the micro jet 3 and the port 16 of the connector 15 defines a continuous port for fluid circulation.

Figure 2:
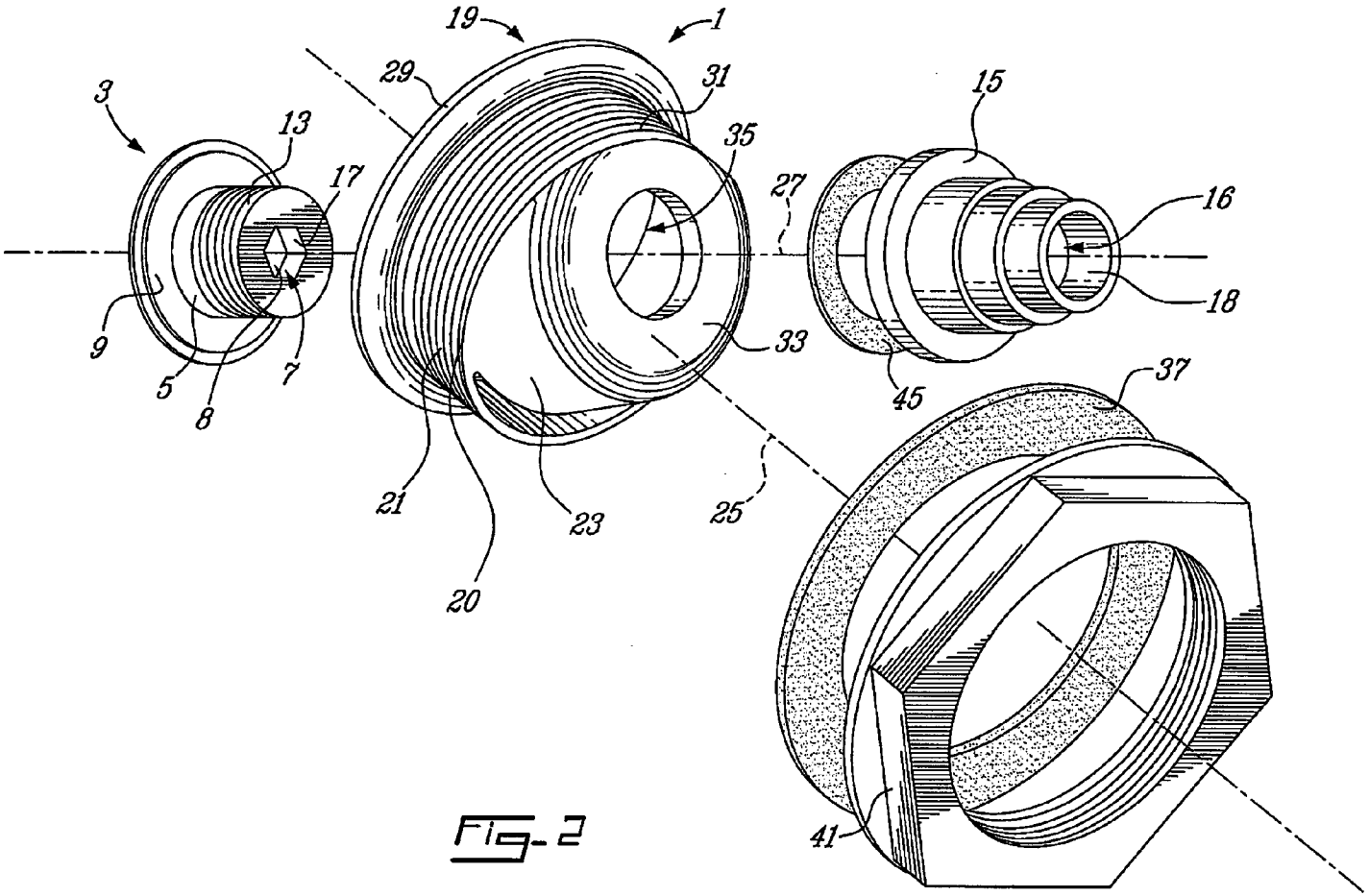
FIG. 2 represents a perspective view of the circular port and polygonal grip of the micro jet and the central aperture of the holding cup.

To mount micro jet 3 in slanted wall 11 of the whirlpool bath, there is provided a massaging micro jet holding cup 19 that will new be described in detail. Holding cup 19 has a peripheral wall 20 which defines a cavity 22. The peripheral wall 20 is a specially designed device that consists of a first cylindrical portion 21 and a second cylindrical portion 23. In the illustrated embodiment, it will be noted that second cylindrical portion 23 has a shorter diameter than first cylindrical portion 21. This may of course vary substantially depending on the preference of the designer. It will also be noted that first cylindrical portion 21 and second cylindrical portion 23 are connected in the continuation of one another and in such a manner that their respective axes 25 and 27 meet at an angle, here approximately 90–θ degrees, wherein θ is the slope of slanted wall 11, the reason being that holding cup 19 is mounted on slanted wall 11 and that second cylindrical portion 23 is used for mounting micro jet 3 and directing its flow of fluid (here water) horizontally as will be described later. Therefore, the holding cup 19, as shown in FIG. 2, is securable or fixable to the shell 59. In the embodiment shown in FIGS. 1 and 3, a free end of the holding cup 19, defined by a mounting flange 29, is secured or fixed to the slanted wall 11 of the bath 12.

Referring again to holding cup 19, it will be seen that cylindrical portion 21 has a mounting flange 29 at its free end and a thread 31 (referred to in the claims as the second thread) that is formed all along its outer surface. With respect to cylindrical portion 23, it is formed with a bottom partition 33 at the free end thereof, and the latter comprises a central aperture 35 that is designed to accommodate cylindrical member 5 of micro jet 3 when assembling the kit.

To complete the kit, there is provided a seal ring 37 that is shaped to fit exactly over thread 31 and to rest tight against the outer surface 39 of slanted wall 11, and a flange nut 41 that is screwable over thread 31 with the flange 29 in contact with the inner surface 40 of slanted wall 11. There is additionally provided a second seal ring 45 that is engageable over thread 13 and is designed to rest against outer surface of bottom partition 33 when assembling the kit.

Connector 15 on the other hand is inwardly threaded at 47 to be engaged with thread 13 of cylindrical member 5.

The whirlpool bath is manufactured with a slanted back wall without recessed parts that is esthetically attractive. If a client wishes to have a micro jet in slanted back wall 11, he is supplied with a kit as described above and the manufacturer will provide slanted wall 11 with an opening 49 that is shaped to receive holding cup 19.

Micro jet 3 and holding cup 19 are made of plastic, stainless steel or any other material known to one skilled in the art.

To mount massaging micro jet 3 after opening 49 has been formed, holding cup 19 is pushed through opening 49 until mounting flange 29 rests against the inner surface of slanted wall 11 all around opening 49. Then, seal ring 37 is placed over thread 31 until it rests against the outer surface 39 of slanted wall 11. Flange nut 41 is then screwed over thread 31 until flange 43 is tight against inner surface of slanted wall 11 and the latter is in fluid proof firm contact with the inner surface of slanted wall 11. Once this is completed, micro jet 3 is fixed into holding cup 3 by inserting cylindrical member 5 thereof through central aperture 35 until fixing flange 9 rests against the inner surface of bottom partition 33. Seal ring 45 is disposed around thread 13 of cylindrical member 5 until it rests against the outer surface of bottom partition 33.

Finally with a special tool (not shown) that is introduced into polygonal grip 17, micro jet 3 is prevented from rotating and threaded connector 15 is threaded over thread 13 until it is firmly and sealingly engaged with micro jet 3: Connector 15 is then linked in known manner to a source of a fluid under pressure, here water.

Micro jet 3 and holding cup 19 can be molded together, in one piece, (referred to in the claims as recessed micro jet) thus eliminating the need to fix and seal micro jet 3 with cup 19.

Figure 3:
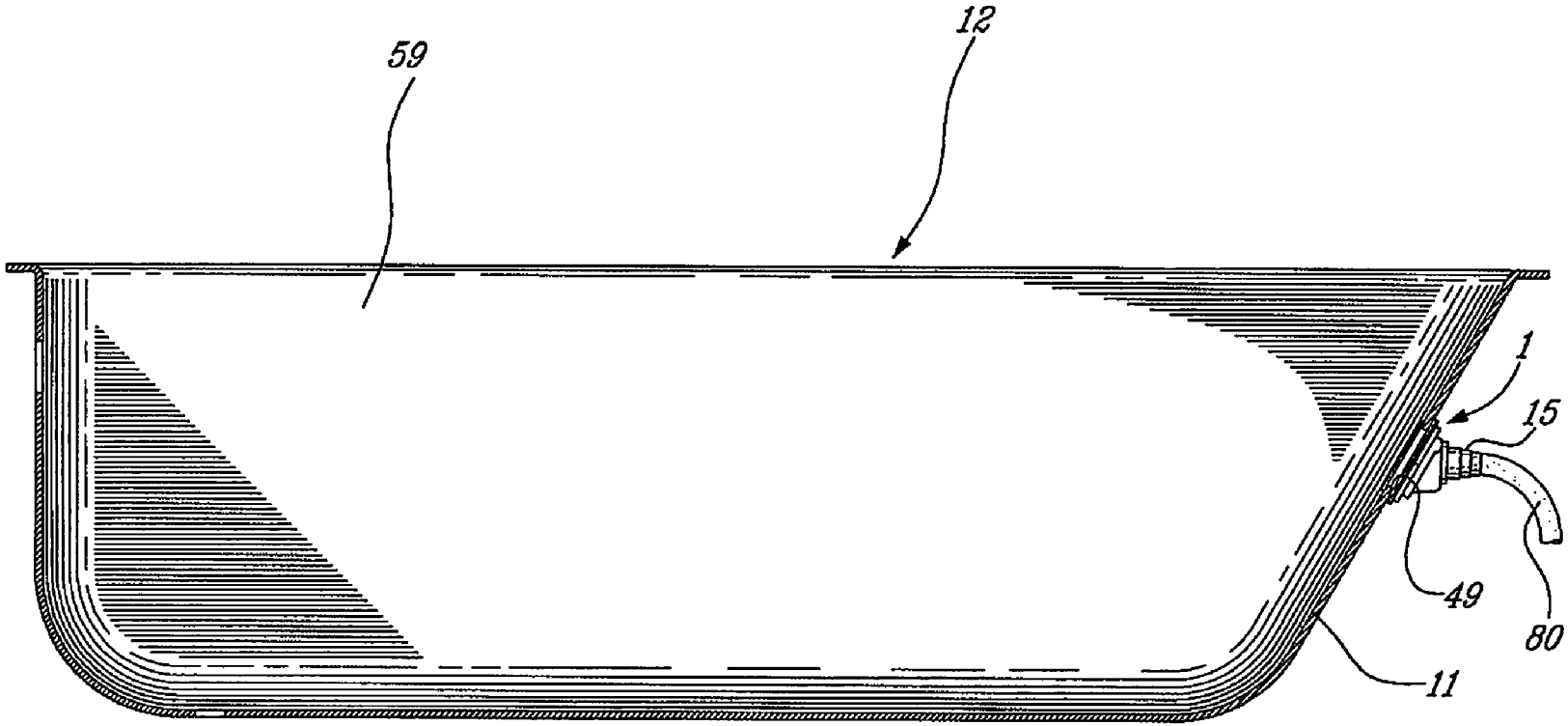
FIG. 3 is a cross-sectional view of a whirlpool bath having the kit including the micro jet and the holding cup shown in FIG. 1 mounted thereto.

Referring to FIG. 3, it will be seen that the kit 1, is mounted to the whirlpool bath 12 by providing the opening 49 in the slanted wall 11 of the whirlpool bath shell 59. The connector 15 is connected to the pressurized fluid supply 80.

It is understood that this kit and the method for mounting same can be used anywhere in a wall of a whirlpool as will be appreciated by one skilled in the art.

It is understood that the invention is not restricted to the above embodiments and that many modifications are possible within the scope of the appended claims.

We claim:

1. A massaging microjet assembly in combination with a whirlpool bath having a shell with an inner surface and an opening therein defined in a slanted wall portion of the shell, the massaging microjet assembly comprising: a holding cup having a free end, a first portion and a second portion in fluid communication with the first portion and being angularly disposed relatively to the first portion, and a bottom partition recessed from the free end, the holding cup being insertable into the opening in the shell, the holding cup protruding outwardly from the opening when inserted therein and the free end being fixable to the shell, and a microjet mounted to the bottom partition and being connectable to a pressurized fluid supply, the microjet having an outlet aperture therein allowing the pressurized fluid to exit therethrough, the outlet aperture being in a substantially horizontal orientation when the holding cup and the microjet are mounted to the shell.

2. A combination as claimed in claim 1, wherein the angle between the first portion and the second portion is substantially equal to the angle of the slanted wall portion with a horizontal orientation.

3. A combination as claimed in claim 1, wherein the microjet comprises a connection member protruding outwardly from the bottom partition of the holding cup, the connection member having a port therethrough in fluid communication with the outlet aperture and being connectable to the pressurized fluid supply.

4. A massaging microjet assembly in combination with a whirlpool bath having a shell with an inner surface and an opening defined in a slanted wall portion of the shell, the massaging microjet assembly comprising:

a holding cup having a free end and a bottom partition recessed from the free end, the holding cup being insertable into the opening in the shell, the holding cup protruding outwardly from the opening when inserted therein and the free end being securable to the shell, the holding cup having a first portion and a second portion in fluid communication with the first portion and being angularly disposed relatively to the first portion, the angle between the first portion and the second portion is substantially equal to the angle of the slanted wall portion with a horizontal orientation; and a microjet mounted to the bottom partition and having an outlet aperture therein and a connection member protruding outwardly from the bottom partition of the holding cup, the connection member having a port therethrough in fluid communication with the outlet aperture and being connectable to a pressurized fluid supply allowing the pressurized fluid to exit through the outlet aperture of the microjet, the outlet aperture being in a substantially horizontal orientation when the holding cup and the microjet are mounted to the shell.

* * * * *